US005642913A

United States Patent [19]

Brown

[11] Patent Number: 5,642,913

[45] Date of Patent: Jul. 1, 1997

[54] METHOD AND APPARATUS FOR REMOVING POLISH FROM A NAIL

[76] Inventor: Kelly M. Brown, Rte. 3, Box 53E, Duncan, Okla. 73533

[21] Appl. No.: 642,109

[22] Filed: May 2, 1996

[51] Int. Cl.[6] ..... A45D 29/17; B25B 9/00

[52] U.S. Cl. ..... 294/100; 132/73

[58] Field of Search ..... 294/19.1, 99.2, 294/100; 15/145, 209.1, 210.1, 229.13, 154; 132/73, 75.3; 606/206, 210

[56] References Cited

U.S. PATENT DOCUMENTS

| | | | |
|---|---|---|---|
| 987,173 | 3/1911 | Sale | 294/100 |
| 1,438,794 | 12/1922 | Tudor | 15/154 |
| 1,839,805 | 1/1932 | Sampson | 294/100 |
| 2,442,051 | 5/1948 | Luscri | 15/209.1 |
| 2,752,625 | 7/1956 | Ponsell | 294/100 |
| 3,481,641 | 12/1969 | Berger et al. | 294/100 |
| 4,283,809 | 8/1981 | Prost | 15/145 |
| 4,575,143 | 3/1986 | Nast | 294/100 |
| 4,987,634 | 1/1991 | Weihrauch | 294/100 |
| 5,439,012 | 8/1995 | D'Agostino | 294/99.2 |

FOREIGN PATENT DOCUMENTS

| | | | |
|---|---|---|---|
| 531617 | 1/1922 | France | 15/154 |

*Primary Examiner*—Dean Kramer
*Attorney, Agent, or Firm*—Thomas R. Weaver

[57] ABSTRACT

A tool is provided for contacting a surface with a treating material without direct personal contact of either the surface treated or the treating material wherein the tool comprises a hollow cylindrical sleeve containing a spring-biased, expandable claw which, upon manual operation of a plunger attached to the claw, grasps, holds and releases the treating material.

16 Claims, 2 Drawing Sheets

METHOD AND APPARATUS FOR REMOVING POLISH FROM A NAIL

FIELD OF THE INVENTION

This invention broadly relates to methods of and apparatus for performing manicuring and pedicuring services involved in the protection, decoration, care and treatment of finger nails and toe nails. This invention further relates to the removal of a coating from finger nails and toe nails. This invention still further relates to an apparatus and a method of using the apparatus to remove a coating of set nail polish from finger nails and toe nails whereby the person using the apparatus does not directly contact any substance or material employed to remove the coating.

PRIOR ART AND PROBLEMS SOLVED

It is known that various liquid polymeric and resinous materials, broadly referred to in the art as "nail polish," are employed in the performance of manicuring and pedicuring services in the protection, decoration, care and treatment of finger nails and toe nails. It is also known that nail polish, after having been applied to a nail and exposed to air and/or light, sets to form a hard coating on the nail. It is further known that the hard coating, from time to time, must be removed from the nail to enable replacement thereof or to facilitate some other treatment of the nail and that a solvent for the hard coating, referred to in the art as "polish remover," can be employed to dissolve the coating to assist in the removal thereof.

When polish remover is employed to dissolve a coating of set nail polish it is known in the art to, first, grasp and hold a small piece of soft, porous material, such as gauze or a cotton ball, with the fingers of one hand, then to saturate the material with polish remover, and then to apply the polish remover to the nail having the coating to be removed by rubbing the coating with the saturated material. It is evident, from the description of the prior art method, that the fingers of the individual holding the saturated material and rubbing the coating are in direct, physical contact with the polish remover. An individual, referred to herein as a "nail tech." who is in the business of performing manicuring and pedicuring services, must, of necessity, be in daily physical contact with polish remover, because virtually every client served during each business period has a coat of set nail polish to be removed.

Polish remover is a composition ordinarily comprising a blend of ketones and alcohols. One such composition comprises water, acetone, methyl ethyl ketone, isopropyl alcohol, a glycol, a stabilizer, a fragrance and coloring. It is known that prolonged or repeated topical use of acetone can cause skin dryness and abnormal redness of the skin and, also, that isopropyl alcohol and methyl ethyl ketone are effective drying agents. Accordingly, a nail tech is especially vulnerable to the damaging effects which polish remover can have on skin. An alternate method of applying polish remover is thus desirable for health reasons.

Furthermore, since polish remover is a very effective solvent for coatings of set nail polish, nail techs, because of the physical contact with polish remover, are prevented from having nails decorated by coatings. The inability of a nail tech to advertise business by a personal display of polished nails to clients can have a dampening effect on the desire for nail polish by clients. An alternate method of applying polish remover is thus desirable for both aesthetic and commercial reasons.

This invention solves the problems and meets the needs described by providing an apparatus and a method of using the same whereby a coating of set nail polish may be removed from a nail with polish remover whereby the person, such as a nail tech, using the apparatus does not experience direct contact with the polish remover.

SUMMARY OF THE INVENTION

By this invention there is provided an apparatus. specifically a tool, which is adapted to grasp, hold and release a quantity of soft, porous material, such as gauze, a sponge or a cotton ball, of a size sufficient to cover a given areal surface, such as the surface of a human finger nail or toe nail. The apparatus of this invention, referred to herein as a manicuring implement, is used in a method of removing a coating, such as set nail polish, from a surface, such as a nail, with a solvent for the coating, such as polish remover, whereby the individual using the manicuring implement, does not come into direct contact with the solvent.

The manicuring implement of this invention is comprised of a hollow cylindrical sleeve, a biasing means, a solid cylindrical plunger and a gripping means, such as a claw, wherein the biasing means, plunger and claw are contained and adapted to axially slide within the interior of the sleeve. The claw, which is detachably connected to one end of the plunger, consists of a plurality of convex flexible tines which, upon axial movement of the plunger in the sleeve, coact with an interior portion of the sleeve whereby the tines radially expand and contract to thereby enable the claw to grasp, hold and/or release solid objects which include both hard rigid material and flexible, soft and porous material.

For purposes of this invention, the terms manicuring, manicure and finger nail include pedicuring, pedicure and toe nail, respectively.

DESCRIPTION OF THE PREFERRED EMBODIMENTS

Figure 1:
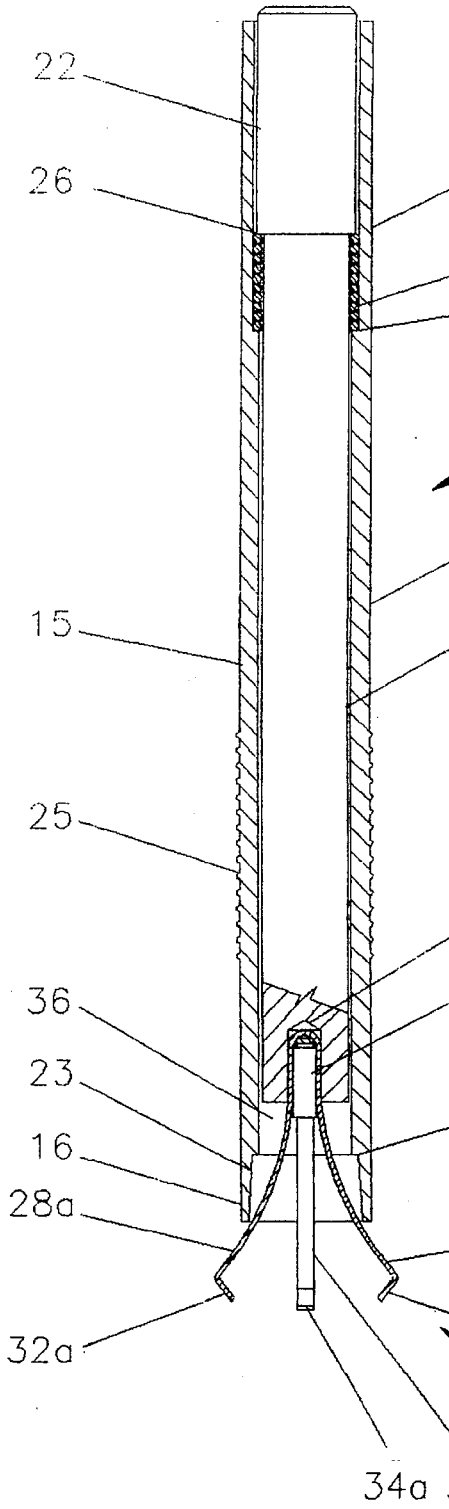
FIG. 1 is a modified longitudinal sectional view of the manicuring implement of this invention in the grasp/release position.
Figure 2:
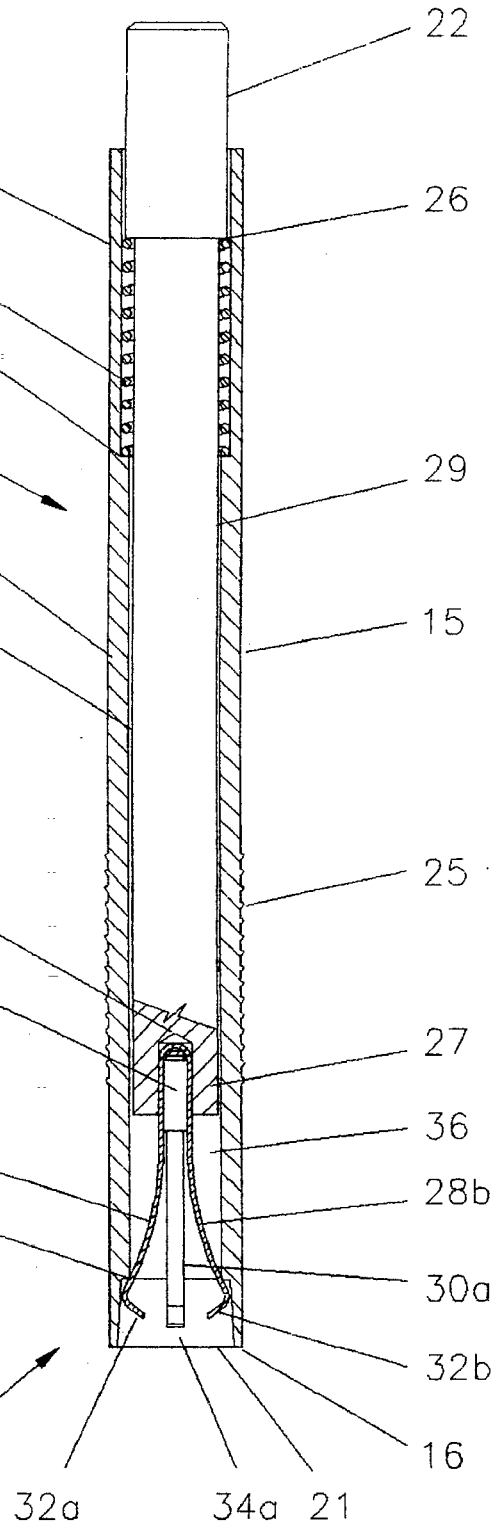
FIG. 2 is a modified longitudinal sectional view of the manicuring implement of this invention in the storage/hold position.

Referring now to FIGS. 1 and 2, there is shown the manicuring implement 2 of this invention which is comprised of exterior housing sleeve 4, plunger 6, helical spring 8, friction pin 10 and claw 12.

Sleeve 4 is an elongated, hollow cylinder having an open upper end portion 14, an open lower end portion 16 and an open central portion 15 intermediate upper portion 14 and lower portion 16. The inside diameter of upper portion 14 is greater than the inside diameter of central portion 15; accordingly, an interior shoulder 18 is formed at the intersection of upper portion 14 and central portion 15. The inside diameter of lower portion 16 is greater than the inside diameter of central portion 15; accordingly, an interior shoulder 20 is formed at the intersection of lower portion 16 and central portion 15. The inside diameter of portion 16 increases from shoulder 20 to end 21 to thereby form a truncated cone having surface 23 which slopes outwardly between shoulder 20 and end 21. The exterior surface of sleeve 4 contains a plurality of serrations 25 near lower portion 16 to thereby form a serrated, non-slip surface.

Helical spring 8 is housed in the interior of hollow sleeve 4 and is of the diameter and length required for it to be maintained and axially slide within upper portion 14 of sleeve 4. Shoulder 18 prevents spring 8 from entering into central portion 15.

Plunger 6, an elongated, solid cylinder having a first end 22, a second end 27 and a shaft 29, intermediate first end 22 and second end 27, is housed in the interior of hollow sleeve 4. The diameter of first end 22 is greater than the inside diameter of central portion 15 but is sufficiently small to enable end 22 to axially slide within upper portion 14 of sleeve 4. First end 22 is, therefore, prevented by shoulder 18 and spring 8 from entering into and sliding in central portion 15. The diameter of shaft 29 is sufficiently small to enable shaft 29 to axially slide within spring 8 and central portion 15 of sleeve 4. Shaft 29 and first end 22 join to form shoulder 26. Axial bore 24 is drilled into the bottom of second end 27 of plunger 6.

The length of plunger 6 is less than the length of sleeve 4. Therefore, cavity 36 is formed between the bottom of end 27 of plunger 6 and end 21 of sleeve 4. The volume of cavity 36 varies with the relaxed or compressed position of spring 8.

Spring 8, which surrounds the portion of shaft 29 which extends into upper portion 14, is confined to the space between shoulders 18 and 26. Accordingly, as seen upon comparing FIG. 1 with FIG. 2, spring 8, when in the relaxed position as shown in FIG. 2, acts to bias first end 22 toward and to extend from end 14 of sleeve 4. In contrast, when spring 8 is in the compressed position, as shown in FIG. 1, shaft 29 is displaced axially within spring 8 and central portion 15 whereby end 27 of plunger 6 is caused to be moved toward end 21 of sleeve 4. When spring 8 is in the relaxed position, then manicuring implement 2 is in the storage/hold position or mode. When spring 8 is in the compressed position, then manicuring implement 2 is in the grasp/release position or mode.

Claw 12 is detachably fastened to the bottom of second end 27 of plunger 6 and consists of at least 2, and preferably 4 or more, convex flexible tines or fingers **28*a*, 28*b*, 30*a* and 30*b*. (It is noted that tine 30*b* is not shown in either FIG. 1 or 2 due to the sectional nature of these Figures.) Tips 32*a* and 32*b* of tines 28*a* and 28*b*, respectively, and tips 34*a* and 34*b* of tines 30*a* and 30*b*, respectively, are permanently creased so that they face in toward the axes of sleeve 4 and plunger 6** to thereby form short, rigid members capable of partially surrounding and holding a hard rigid material and at least partially penetrating or gripping a soft porous material.

Each of the flexible tines, for example **28*a* and 28*b*, is one half of a continuous, curved, flat metal strip which contains a permanent curved bend substantially in the center of the metal strip so as to form two curved halves convex each to the other. The outside radius of the bend is not greater than, and preferably equal to, the radius of axial bore 24 in end 27 of plunger 6. The central bend of the metal strip is such that the tendency of the metal strip is to move radially outwardly to a relaxed position substantially as shown in FIG. 1. In view of the above discussion, it is apparent that the tips of each tine of each bent metal strip are in a facing relationship, i.e., tip 32*a* and tip 32*b*** face one another across a common diameter.

The central curved bend of each metal strip is forced into bore 24 whereby the tines axially protrude from the bottom of end 27 as shown in FIGS. 1 and 2. When two bent strips are forced into bore 24, as shown in FIGS. 1 and 2, the strips are preferably placed such that the each adjacent the is spaced at 90 degree intervals. The strips are retained in bore 24 by pin 10 which is driven into the space between tines to thereby force the sides of the tines against the walls of bore 24, whereby sufficient friction is developed to hold the tines in bore 24.

Upon axial movement of plunger 6 in sleeve 4, tines **28*a*, 28*b*, 32*a* and 32*b*, in cooperation with sloped surface 23 and the interior walls of open lower portion 16 of sleeve 4**, radially expand and contract.

When manicuring implement 2 is in the storage/hold position or mode, as shown in FIG. 2, claw 12 is drawn toward and substantially into cavity 36 in the lower interior of sleeve 4 by the biasing effect of spring 8. The flexible tines are forced radially inward by surface 23 to thereby enable the tips of the tines to grasp and hold an object, such as a soft porous material or even a small solid object, such as the barrel of a pencil or an object of similar diameter.

When manicuring implement 2 is in the grasp/release position or mode, as shown in FIG. 1, claw 12 extends from cavity 36 and end 21 to thereby permit the biasing effect of the flexible tines to expand the tips of the tines radially outward whereby the tips are positioned to either grasp or release an object.

The specific materials of construction of manicuring implement 2 and the various elements thereof do not form an integral part of this invention. However, the materials must have sufficient mechanical strength to withstand repeated daily use and must be of a chemical nature to resist attack by chemicals involved in the intended use and care of the tool. In this regard, the tool is in daily contact with polish remover, the content of which was previously noted. Furthermore, the tool is normally treated with compositions such as trialkyl aryl ammonium chlorides and trialkyl alkaryl ammonium chlorides the purpose of which is to disinfect, clean, sanitize and deodorize the tool. It has been found that polyalkylene materials, such as polypropylene, and stainless steel are suitable to provide a tool which resists the corrosive and deteriorating effects of chemicals normally encountered and provides sufficient mechanical strength to provide dependable daily use. In a preferred tool of this invention sleeve 4 and plunger 6 are made of polypropylene and claw 12, pin 10 and spring 8 are made of stainless steel.

OPERATION OF THE INVENTION

Figure 4:
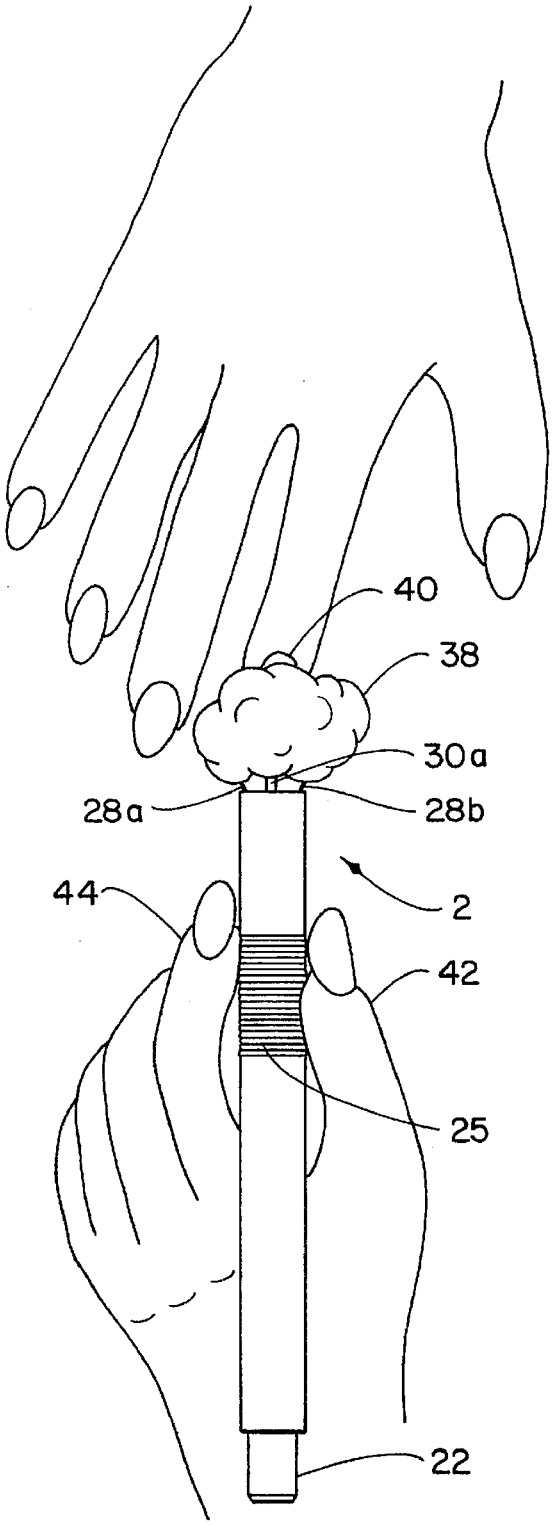
FIG. 4 is an artist's conception of a human hand using the manicuring implement of this invention holding a cotton ball to remove a coating from the finger nail of another human hand.
Figure 3:
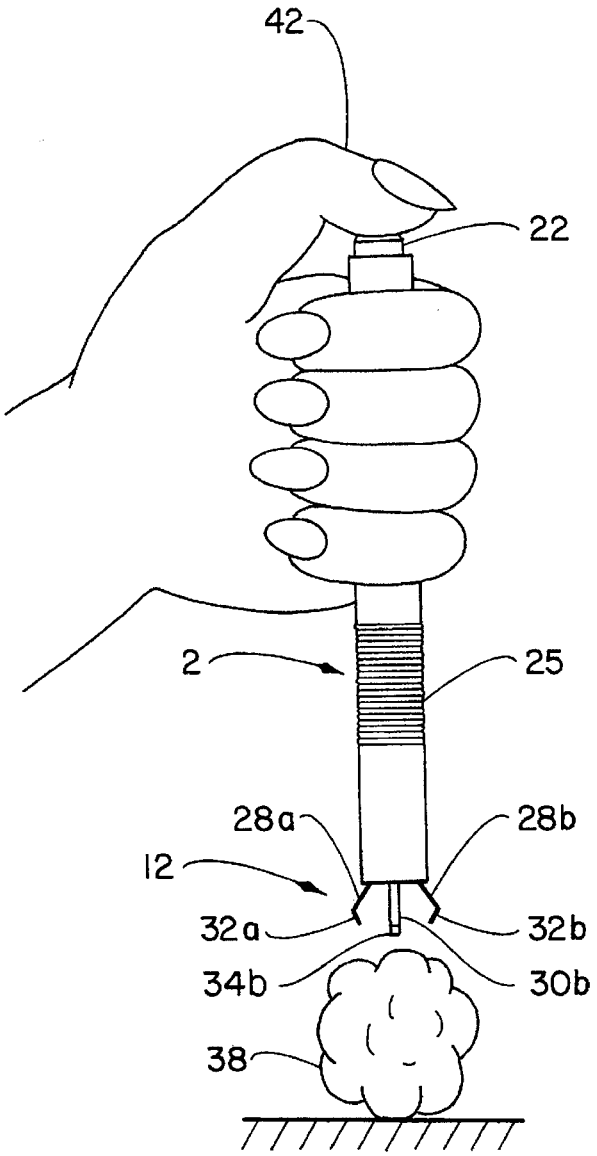
FIG. 3 is an artist's conception of a human hand holding the manicuring implement of this invention in the grasp/release position preparatory to grasping or subsequent to releasing a cotton ball.

Referring now to FIGS. 3 and 4, manicuring implement 2 is held, preferably vertically, between the fingers and palm of a hand, as shown in FIG. 3, such that thumb 42 is enabled to contact and press down against the portion of end 22 of plunger 6 which extends from upper portion 14 of sleeve 4. Upon pressing down against end 22, spring 8 is compressed and claw 12 is caused to extend from end 21 of sleeve 4 and to radially expand whereby tips **32*a*, 32*b*, 34*a* and 34*b* spread. At that point, tips 32*a*, 32*b*, 34*a* and 34*b* are pressed against cotton ball 38 and pressure exerted against end 22 by thumb 42 is then discontinued. Spring 8 then returns to the relaxed position which causes claw 12 to retract into cavity 36 and tips 32*a*, 32*b*, 34*a* and 34*b* to close against, grass and hold cotton ball 38. It is noted that cotton ball 38 prevents tips 32*a*, 32*b*, 34*a* and 34*b* from completely entering cavity 36 as shown in FIG. 4**.

With cotton ball 38 retained in claw 12 cotton ball 38 is then saturated with polish remover. This can be done by merely dipping the ball into a container of polish remover. However, manicurists conventionally press the cotton ball against a mechanical pump attached to a closed container of polish remover which causes a measured amount of polish remover to be sprayed on cotton ball 38. The saturation of cotton ball 38 with polish remover while cotton ball 38 is held by manicuring implement 2 is accomplished without direct contact between the manicurist and the polish remover.

Thereafter, implement 2 can be held at serrations 25 between thumb 42 and forefinger 44 of a hand as shown in FIG. 4 and solvent saturated cotton ball 38 is pressed against and rubs set nail polish on a nail 40 of another hand until the nail polish is completely removed from the nail.

It has been found that a nail tech can remove set nail polish from all ten fingers of a client in 3 to 5 minutes while using only one cotton, ball and without any direct physical contact between the nail tech and the polish remover.

It has also been found that the client is contacted solely by cotton saturated with polish remover. Manicuring implement 2 does not contact the client even though the tines of claw 12 are not completely enclosed in cavity 36 when cotton ball 38 is held by the tool.

After set nail polish is removed, the used solvent-saturated cotton ball 38 is easily released from the tool by depressing end 22 as shown in FIG. 3 and permitting cotton ball 38 to fall off into a refuse receptacle.

Although this invention has been disclosed in terms applicable to manicuring methods, it will be appreciated that the tool and the method of its operation and use have much broader uses and applications, such as in manual medical, dental and other procedures wherein precise indirect control of solids and liquid blotting or liquid application are required.

Having thus described the invention that which is claimed is:

1. A tool for grasping, holding and releasing a solid object, said tool comprising a sleeve, a plunger, a biasing means and a gripping means wherein:

said sleeve is an elongated hollow cylinder having an open upper portion, an open lower portion and an open central portion intermediate said upper portion and said lower portion wherein the inside diameter of said central portion is less than the inside diameter of said upper portion and less than the inside diameter of said lower portion;

said plunger comprises a first upper end and a second lower end and is contained in and adapted to axially slide solely within the interiors of said upper portion and said central portion of said sleeve;

said biasing means is contained in and adapted to axially slide solely within the interior of said upper portion of said sleeve; and said gripping means is detachably fastened to said second lower end of said plunger and is contained in and adapted to axially slide within the interior of said lower portion of said sleeve.

2. The tool of claim 1 wherein said central portion of said sleeve and said lower portion of said sleeve intersect to form a first interior shoulder, said inside diameter of said lower portion of said sleeve increases from said first interior shoulder to the end of said lower portion and said central portion of said sleeve and said upper portion of said sleeve intersect to form a second interior shoulder.

3. The tool of claim 2 wherein said plunger is an elongated solid cylinder having a shaft intermediate said first upper end and said second lower end wherein:

the diameter of said first upper end is greater than the diameter of said shaft whereby a third interior shoulder is formed at the intersection of said first upper end and said shaft;

the diameter of said first upper end is less than said inside diameter of said upper portion of said sleeve and greater than said inside diameter of said central portion of said sleeve; and the diameter of said shaft is less than said inside diameter of said central portion of said sleeve;

whereby said second interior shoulder and said third interior shoulder prevent said first upper end of said plunger from entering into and sliding in said central portion of said sleeve.

4. The tool of claim 3 wherein said biasing means is a coil spring maintained in said upper portion of said sleeve between said second interior shoulder and said third interior shoulder and said shaft is adapted to axially slide within the coils of said coil spring.

5. The tool of claim 4 wherein said gripping means is a claw having at least two convex flexible tines, said tines, upon axial movement of said lunger in said sleeve, extend from the end of, slide in and cooperate with the inside surface of said open lower portion of said sleeve to radially expand and contract whereby said claw grasps, holds and releases said solid object.

6. The tool of claim 5, wherein said claw consists of four of said tines which are enclosed within said lower portion of said sleeve when said coil spring is in a relaxed position.

7. A method for a person to perform a treatment of a surface with a solid object without direct physical contact between said person and said solid object, said method being comprised of the steps of:

grasping said solid object with a tool comprised of a sleeve, a biasing means, a plunger and a gripping means;

holding said tool with said solid object in the grasp of said tool;

contacting said surface with said solid object in the grasp of said tool for a time sufficient to treat said surface; and thereafter releasing said solid object from said tool;

wherein said sleeve is an elongated hollow cylinder having an open upper portion, an open lower portion and an open central portion intermediate said upper portion and said lower portion wherein the inside diameter of said central portion is less than the inside diameter of said upper portion and less than the inside diameter of said lower portion;

said plunger comprises a first upper end and a second lower end and is contained in and adapted to axially slide within the interiors of said upper portion and said central portion of said sleeve;

said biasing means is contained in and adapted to axially slide solely within the interior of said upper portion of said sleeve; and said gripping means is detachably fastened to said second lower end of said plunger and is contained in and adapted to axially slide within the interior of said lower portion of said sleeve.

8. The method of claim 7 wherein said steps of grasping and releasing said solid object are comprised of causing said first upper end of said plunger to axially move in said sleeve whereby said gripping means extends from the end of said lower portion of said sleeve, radially expands and contracts to grasp and release said solid object.

9. The method of claim 8 wherein said gripping means is a claw comprising a plurality of convex flexible tines detachably connected to said plunger wherein said tines, upon said axial movement of said plunger in said sleeve, coact with the interior of said sleeve whereby said tines radially expand and contract to thereby enable said claw to grasp, maintain and release said solid object.

10. The method of claim 9 wherein said surface is set nail polish on a nail and said solid object is a cotton ball saturated with polish remover.

11. A manicuring tool for grasping, holding and releasing a soft porous material, said tool comprising:

an elongated cylindrical sleeve having a hollow interior, an open upper portion, an open lower portion and an open central portion intermediate said upper portion and said lower portion wherein the inside diameter of said central portion is less than the inside diameter of said upper portion and less than the inside diameter of said lower portion;

a coil spring contained in and adapted to axially slide solely within the interior of said upper portion of said sleeve;

an elongated solid cylindrical plunger having a first end, a second end and a shaft, intermediate said first end and said second end, wherein said first end of said plunger extends from the top of and is adapted to axially slide solely within said upper portion of said sleeve, and said shaft is contained in and adapted to axially slide solely within said central portion of said sleeve and within said coil spring; and a claw detachably fastened to said second end of said plunger, said claw having at least two flexible tines which, upon axial movement of said plunger in said sleeve, axially slide within and cooperate with the interior of said open lower portion of said sleeve to radially expand and contract.

12. The tool of claim 11 wherein said central portion of said sleeve and said lower portion of said sleeve intersect to form a first interior shoulder, said inside diameter of said lower portion of said sleeve increases from said first interior shoulder to the bottom end of said lower portion of said sleeve and said central portion of said sleeve and said upper portion of said sleeve intersect to form a second interior shoulder.

13. The tool of claim 12 wherein the diameter of said first and of said plunger is grater than the diameter of said shaft whereby a third interior shoulder is formed at the intersection of said first end and said shaft;

the diameter of said first end of said plunger is less than said inside diameter off said upper portion of said sleeve and greater than said inside diameter of said central portion of said sleeve; and the diameter of said shaft is less than said inside diameter of said central portion of said sleeve;

whereby said second interior shoulder and said third interior shoulder prevent said first end of said plunger from entering into and sliding in said central portion of said sleeve.

14. The tool of claim 13 wherein said coil spring is confined in said upper portion of said sleeve between said second interior shoulder and said third interior shoulder.

15. The tool of claim 14, wherein said claw consists of four of said tines which are housed within said lower portion of said sleeve when said coil spring is it, a relaxed position.

16. The tool of claim 15 wherein said soft porous maternal is a cotton ball saturated with polish remover.

* * * * *